US009530268B1

(12) United States Patent
Lavigne et al.

(10) Patent No.: US 9,530,268 B1
(45) Date of Patent: Dec. 27, 2016

(54) ADA COMPLIANT COIN RECYCLING DEVICE

(71) Applicant: Revolution Retail Systems, LLC, Carrollton, TX (US)

(72) Inventors: Matthew O. Lavigne, Carrollton, TX (US); Robert F. Casteel, Plano, TX (US); Mark K. Levenick, Flower Mound, TX (US)

(73) Assignee: Revolution Retail Systems, LLC, Carrollton, TX (US)

( * ) Notice: Subject to any disclaimer, the term of this patent is extended or adjusted under 35 U.S.C. 154(b) by 0 days.

(21) Appl. No.: 14/753,230

(22) Filed: Jun. 29, 2015

(51) Int. Cl.
*G07D 1/00* (2006.01)
*G07D 3/14* (2006.01)

(52) U.S. Cl.
CPC . *G07D 3/14* (2013.01); *G07D 1/00* (2013.01)

(58) Field of Classification Search
CPC .. G07D 1/00; G07D 11/0003; G07D 11/0018; G07D 11/0081; G07D 2201/00; G07F 9/10
USPC ..... 453/3; 194/350
See application file for complete search history.

(56) References Cited

U.S. PATENT DOCUMENTS 4,416,299 A * 11/1983 Bergman ..... G07D 9/008 198/549
5,082,100 A * 1/1992 Guyonneau ..... G07D 1/00 194/343
7,625,272 B1 * 12/2009 Moreland ..... G07D 3/14 141/358
7,644,039 B1 * 1/2010 Magee ..... G06Q 20/1085 221/9
8,833,538 B2 * 9/2014 Oh ..... G07F 19/20 194/350
2014/0331189 A1 * 11/2014 Lee ..... G06F 3/04883 715/863

FOREIGN PATENT DOCUMENTS

JP 2007-156999 A * 6/2007 ..... G07B 15/00

* cited by examiner

*Primary Examiner* — Mark Beauchaine
(74) *Attorney, Agent, or Firm* — Locke Lord, LLP

(57) ABSTRACT

The present invention relates generally to an ADA compliant coin recycler device that is capable of sorting a mixed denomination of coins, storing the coins and dispensing the desired amount of coins in the desired denomination. Additionally, the ADA compliant coin recycler device of the present invention also comprises a coin elevator assembly attached to the outside of the housing, which receives coins from the coin recycler and elevates the coins to an accessible height above the ADA's Standards for Accessible Design minimum reach requirement.

5 Claims, 5 Drawing Sheets

ADA COMPLIANT COIN RECYCLING DEVICE

BACKGROUND OF THE INVENTION

1. Field of the Invention

The present invention relates generally to an ADA compliant coin recycling device and method of use thereof. More specifically, the invention relates to a coin recycling device for sorting mixed denomination coins and for dispensing sorted denomination coins that is compliant with the accessibility requirements of the American with Disabilities Act.

2. Description of Related Art

Recycling of coins is typically done in retail, banking and other cash-based operations where batches of mixed denomination coins are sorted for subsequent use. For example, a cashier at the beginning of a shift requires a cash till drawer to be filled with coins for use in dispensing change to customers. The cash till drawers have coin receptacles that are arranged in coin denomination order. If the cashier requires additional coins of one or more denominations to refill the till during the shift, coin change cups are utilized for receiving coins to be added to the cash till drawer.

Prior art coin recyclers used to fill cash till drawers, like the one disclosed in U.S. Pat. No. 7,625,272, are capable of receiving a batch of mixed denomination coins, sorting the coins into their denominations and dispensing the desired amount of each denomination into that denomination's proper coin receptacle in the cash till drawer or into a coin change cup. The devices are comprised of a coin input area for receiving the batch of mixed denomination coins, a coin sorter capable of validating, counting and sorting a batch of mixed denomination coins, a first manifold for receiving the sorted coins and directing them into the appropriate coin hoppers, coin hoppers capable of storing coins of a particular denomination and dispensing a desired number of coins on demand, and a second manifold for receiving the coins dispensed from the coin hoppers and directing them into the appropriate compartment in the cash till drawer (or coin change cup), which fits into a housing below the second manifold. The devices are further operated via a computer and an associated software application which controls the coin recycler and guides users through its operations via on-screen instructions.

Coin recyclers of the kind described here rely upon gravity to move the coins into the coin sorter, through the first manifold and into the segregated coin hoppers. Further, gravity is used to move the coins after they are dispensed from the coin hoppers into the second manifold and ultimately into the cash till drawer receptacles of coin change cups. This reliance on gravity to move the coins places a physical constraints on the height of the coin recycler as there is a minimum distance between the coin input area at the top for receiving the coins and the exit of the coins from the second manifold into the cash till drawer. Section 308.2 of the 2010 ADA Standards for Accessible Design requires that "when a forward reach is unobstructed, the high forward reach shall be 48 inches maximum and the low forward reach shall be 15 inches minimum above the finish floor or ground." Therefore, for any coin recycler to be ADA compliant, the coin input area cannot be above 48 inches from the floor and the coin dispensing area are the bottom of the second manifold cannot be below 15 inches from the floor. This 33 inch difference is not enough vertical drop for the coin recyclers of the type described to operate as there is not enough room for the coin input area, sorter, first manifold, hoppers, second manifold and housing for the cash till drawer or coin change cups.

It is therefore desirable to have a coin recycler device capable of sorting a mixed denomination of coins, storing said coins and dispensing said coins when desired that is also compliant with the ADA Standards for Accessible Design.

SUMMARY OF THE INVENTION

The present invention provides generally for an ADA compliant coin recycler device that is capable of sorting a mixed denomination of coins, storing the coins and dispensing the desired amount of coins in the desired denomination. The coin recycler device of the present invention includes a housing having a coin input area and a coin sorter for receiving and sorting the batch of mixed denomination coin. A first manifold for receiving coins from the sorter and directing the coins into a plurality of coin hoppers. The first manifold includes a plurality of coin paths with each coin path receiving coins of a set denomination and delivering those coins to a specific coin hopper designated for coins of that denomination. The coin hoppers each store one denomination of coin and are operable to dispense the stored coins into a second manifold. The second manifold also consists of individual coin paths configured to direct coins in coin denomination order for subsequent dispensing into the appropriate compartment in the cash till drawer (or coin change cup), which fits into a housing below the second manifold. The coin recycler also incorporates a controlling software application for controlling the recycler and guides registered users through the operations via on-screen instructions.

Additionally, the ADA compliant coin recycler device of the present invention also comprises a coin elevator assembly attached to the outside of the housing, which receives coins from the coin recycler and elevates the coins to an accessible height above the 15 inch minimum reach requirement. The coin elevator assembly is comprised of an opening at the bottom of the coin elevator for receiving coins from the coin recycler and allowing access to a coin lift bucket. The coin elevator raises the coin lift bucket to an opening at the top of the coin elevator where a user can access the coin lift bucket to remove the coins. The top opening also has a safety door that remains closed until the coin lift bucket has been raised completely into the access position at the top of the coin elevator.

The coin recycler cash till drawer housing incorporates a flap, and when no cash till drawer is inserted into the housing, coins from the second manifold fall onto a conveyor mechanism, which moves the coins sideways from under the second manifold to a chute on the side of the coin recycler where they are then deposited through the bottom opening of the coin elevator assembly into the coin lift bucket. If a registered user of the coin recycler is in need of the ADA compliant coin elevator feature, then the controlling software of the coin recycler automatically utilizes the coin elevator and provides on-screen guidance to use the coin elevator rather than inserting the cash till drawer.

To use the ADA compliant coin recycler of the present invention, a user who was turning in coins would identify themselves to the device, preferably through a palm scanner, and follow the on-screen instructions for depositing coins. The user would begin by placing the mixed denomination batch of coins to be recycled into the coin input area where the coins would be fed into the coin sorter. The sorter would sort the coins by denomination and deposit the coins into the appropriate coin paths of the first manifold, which would deliver the coins to the appropriate coin hoppers. A user who was wishing to receive coins from the coin recycler would again identify themselves to the device and follow the on-screen instructions for receiving coins, which would include a selection of the value and denomination of coins desired. If the user is not in need of the ADA compliant feature (i.e., the coin elevator), then the user would insert the cash till drawer into the housing at the bottom of the safe. The coin hoppers housing the coins of the selected denominations would dispense the selected amount of coins, which would pass through the coin paths of the second manifold and into the appropriate compartments in the cash till drawer. If the user is in need of the ADA compliant feature, the user would not insert the cash till drawer into the housing. With the cash till drawer not in place, the flap will cause the coins to fall from the coin paths of the second manifold on the conveyor mechanism, which delivers the coins to the coin elevator assembly. The coin elevator will raise the coins to a height above the ADA required minimum (currently 15 inches) to provide the user access to the coins.

The novel features and construction of the present invention, as well as additional objects thereof, will be understood more fully from the following description when read in connection with the accompanying drawings.

BRIEF DESCRIPTION OF THE DRAWINGS

The invention is further described and explained in relation to the following figures of the drawings wherein.

Like reference numerals are used to describe like parts in all figures of the drawings.

DESCRIPTION OF THE PREFERRED EMBODIMENTS

Figure 1:
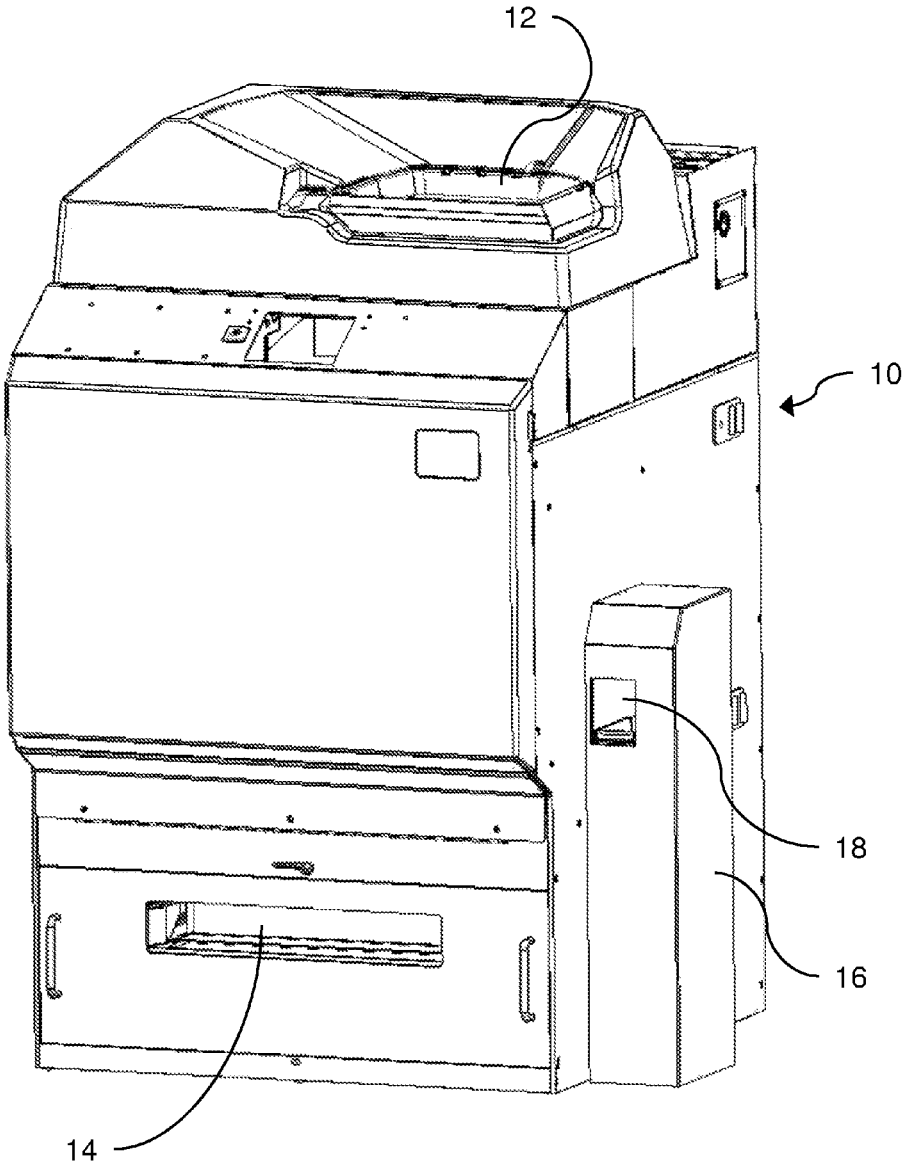
FIG. 1 is a perspective view of the ADA compliant coin recycling device of the present invention.

Referring to FIG. 1, ADA-compliant coin recycling device 10 is shown. Coin recycling device 10 is capable of receiving a batch of mixed denomination coins, sorting the coins into denominations and dispensing the desired amount of coins. The batch of mixed denomination coins is received by coin recycling device 10 through coin input area 12. From there, the coins are sorted by denomination and pass into a first manifold consisting of individual coin paths for each coin denomination. The coins pass from the first manifold into internal hoppers for each coin denomination until the coins are dispensed. The coins can be dispensed directly into a cash till drawer, which fits in drawer housing 14 near the bottom of coin recycling device 10. Alternatively, the coins can be dispensed into ADA-compliant coin elevator assembly 16, which raises the coins from the height of drawer housing 14 to opening 18 of coin elevator assembly 16. Opening 18 is at a distance above the floor that complies with the ADA Standards for Accessible Design. Currently, Section 308.2 of the 2010 ADA Standards for Accessible Design mandates that Opening 18 be at least 15 inches above the finish floor or ground.

Figure 2:
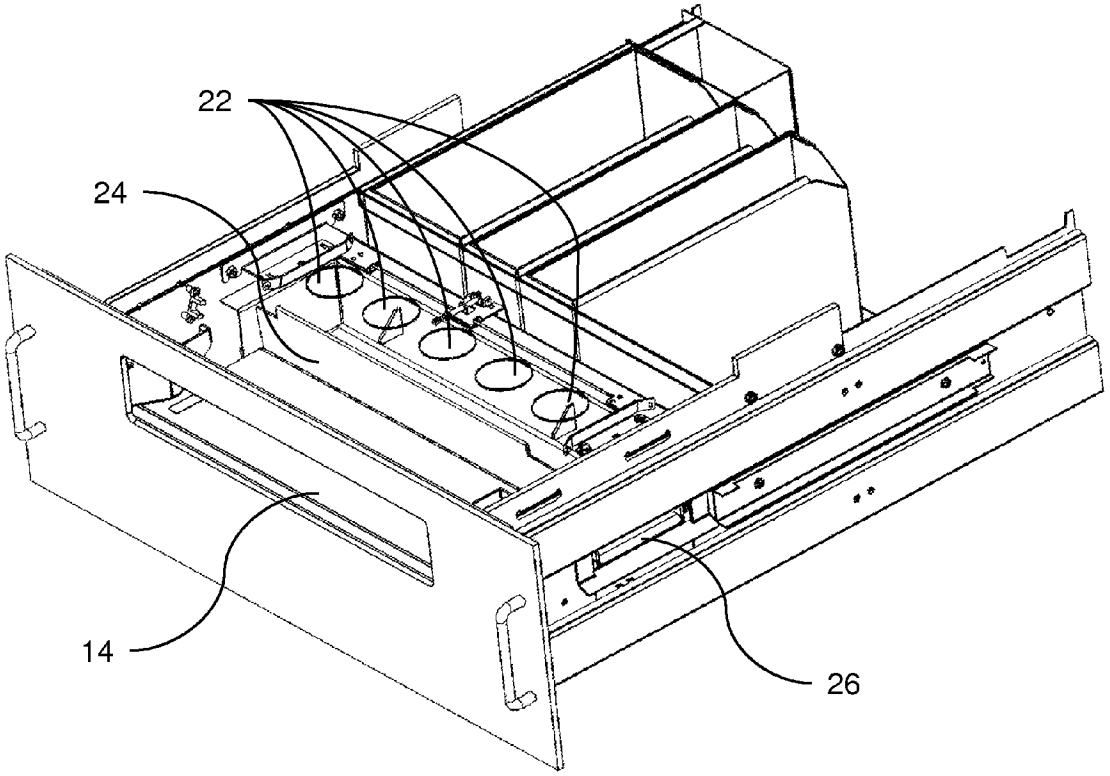
FIG. 2 is a perspective view of the lower coin-dispensing section of the coin recycling device.
Figure 3:
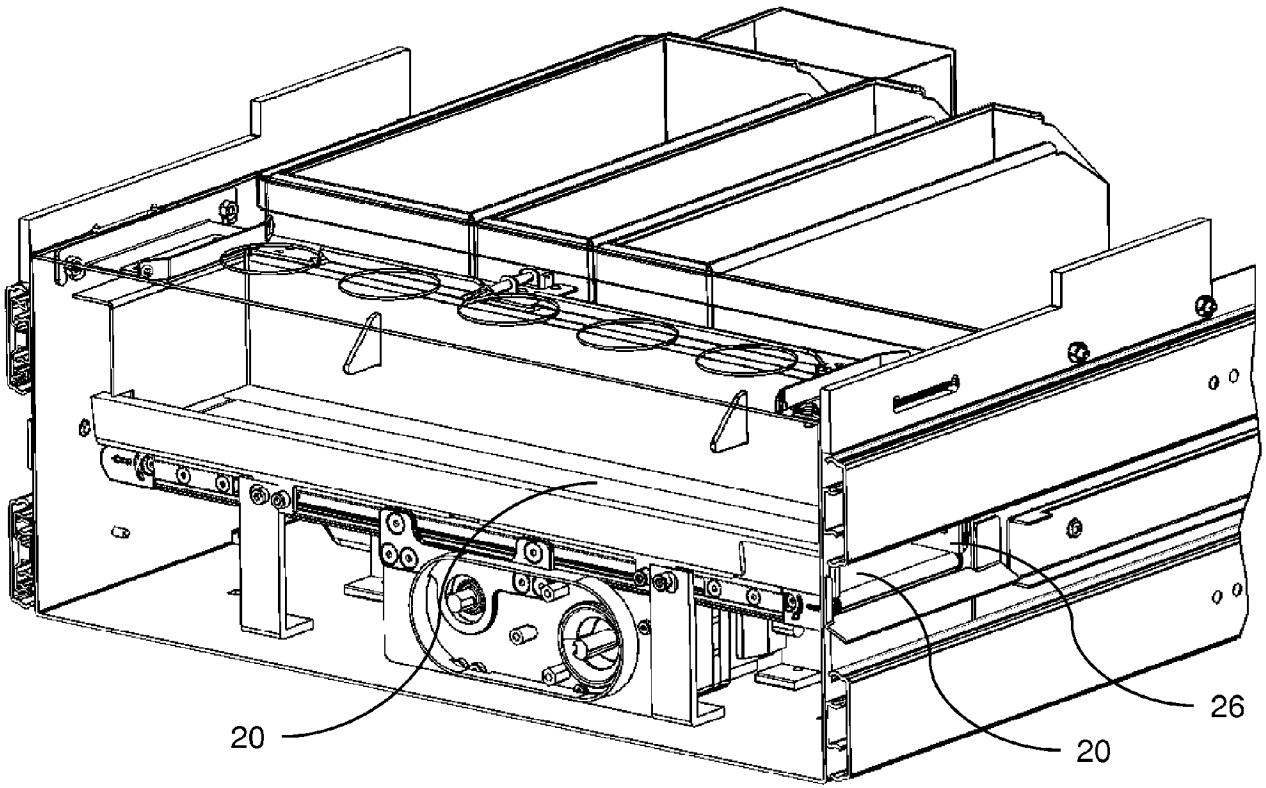
FIG. 3 is a cut-away view of the lower coin-dispensing section of the coin recycling device.

Referring to FIGS. 2 and 3, the lower coin-dispensing section of ADA-compliant coin recycling device 10 is shown. After the coins are sorted and stored in the coin hoppers, they are dispensed into a second manifold, which consists of individual coin paths that terminate directly above drawer housing 14. Second manifold coin path tube termination points 22 are spaced appropriately such that the coins will fall directly into the appropriate compartments of a cash till drawer placed in drawer housing 14. When a cash till drawer is inserted in drawer housing 14, flap 24 hinges down flat. Coins fall directly through termination points 22 into the cash till drawer compartments. If no cash till drawer is inserted in drawer housing 14, then flap 24 remains in a vertical orientation to prevent dispensed coins from spilling out the front of coin recycling device 10 through drawer housing 14. In this situation, the coins pass through termination points 22 and land on conveyor belt 20, which moves the coins laterally towards coin elevator assembly 16 (not shown) via side cutout 26.

Figure 4:
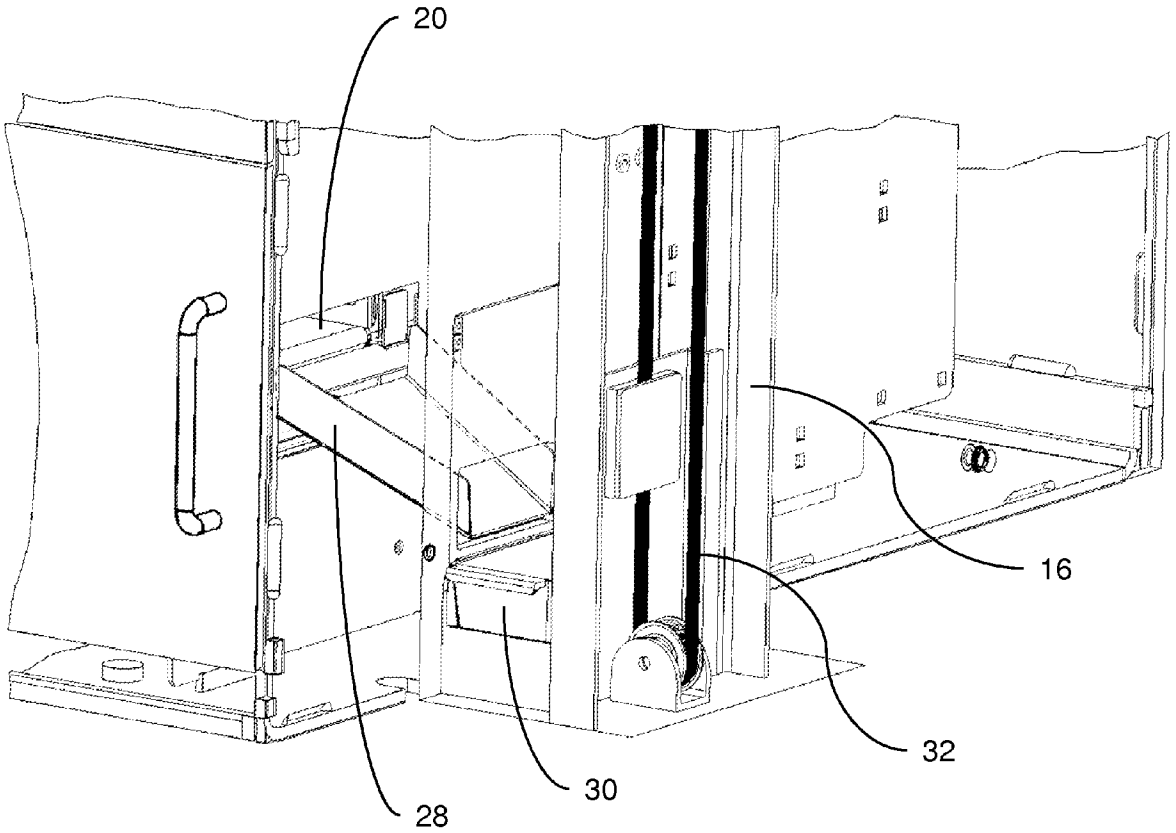
FIG. 4 is a cut-away view of the coin chute and coin elevator assembly of the coin recycling device.

Referring to FIG. 4, the lower section of coin elevator assembly 16 is shown. After the coins are dispensed onto conveyor belt 20, the coins are moved laterally via conveyor belt 20 to chute 28. The coins slide down chute 28 into coin lift bucket 30, which is in its lower position in coin elevator assembly 16. Once the coins arrive into coin lift bucket 30, coin lift bucket 30 is raised via belt drive system 32 to its raised position where the coins are accessible.

Figure 6:
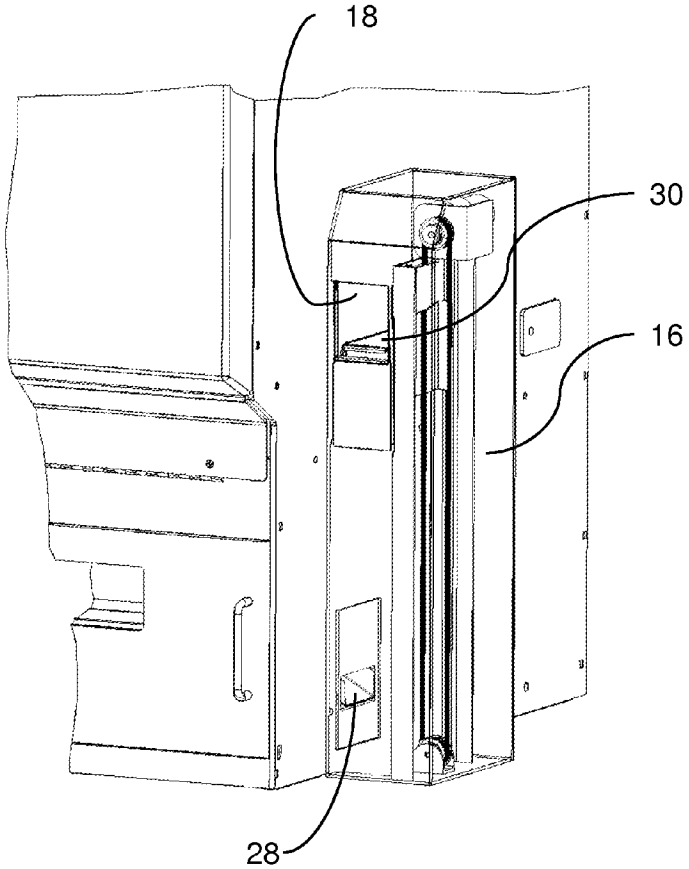
FIG. 6 is a cut-away view of the coin elevator assembly of the coin recycling device in its raised position.
Figure 5:
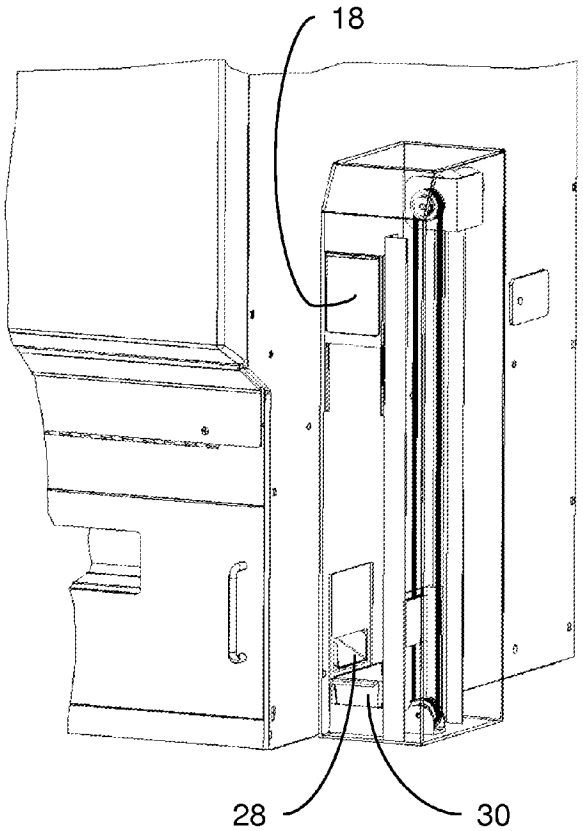
FIG. 5 is a cut-away view of the coin elevator assembly of the coin recycling device in its lowered position.

Referring to FIGS. 5 and 6, the operation of coin elevator assembly 16 is shown. In FIG. 5, coin lift bucket 30 in its lower position to receive coins via chute 28. Once the coins are received in coin lift bucket 30, coin lift bucket 30 is raised to its upper position as shown in FIG. 6. Once coin lift bucket 30 is raised to its upper position, the coins are accessible through opening 30 in the upper portion of coin elevator assembly 16.

ADA-compliant coin recycling device 10 incorporates a controlling software application for controlling the various aspects of the recycler as well as guiding users through its operation. If a registered user of recycler 10 is in need of the ADA-complaint features, the controlling software automatically uses coin elevator assembly 16 to deliver the coins in an ADA-complaint manner and provides guidance to the user to use coin elevator assembly 16 rather than inserting a cash till drawer into drawer housing 14.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

The invention claimed is:

1. A coin recycling device with ADA-compliant features comprising:

a housing;

said housing including a coin input area for receiving coins;

a coin sorter disposed in said housing for sorting the coins into different denominations;

a plurality of coin hoppers for storing the coins of sorted denominations and operable to dispense coins stored therein; and a coin elevator assembly comprising a repositionable coin lift bucket that in a lower position is able to receive the coins dispensed from the coin hoppers and in an upper position is accessible at an at least ADA-compliant minimum reach height.

2. The coin recycling device of claim 1 further comprising a cash till drawer housing for receiving a cash till drawer.

3. The coin recycling device of claim 2 wherein if the cash till drawer is inserted into the cash till drawer housing, the coins from said coin hoppers are dispensed into appropriate compartments of the cash till drawer.

4. The coin recycling device of claim 1 wherein the coin elevator assembly is located on a side of said housing and the coins from said coin hoppers are dispensed onto a conveyor belt that moves the coins laterally into coin elevator assembly.

5. A method for using a coin recycling device in an ADA-compliant manner, said method comprising the steps of:

identifying the user as one needing or desiring the coin recycling device to operate in an ADA-compliant manner;

determining an amount of coins desired to be dispensed;

causing the coin recycling device to dispense the desired amount of coins;

transporting said desired amount of coins from a plurality of coin hoppers to a coin elevator assembly with a repositionable coin lift bucket that in a lower position is able to receive the coins dispensed from the coin hoppers and in an upper position is accessible at an at least ADA-compliant minimum reach height;

wherein the coin elevator assembly raises the coins dispensed to an ADA-compliant minimum reach height.

* * * * *